US005158329A

United States Patent [19]

Schlack

[11] Patent Number: 5,158,329

[45] Date of Patent: Oct. 27, 1992

[54] SLAM LATCH

[75] Inventor: Richard E. Schlack, Unionville, Pa.

[73] Assignee: Southco, Inc., Concordville, Pa.

[21] Appl. No.: 763,321

[22] Filed: Sep. 20, 1991

[51] Int. Cl.[5] ..... E05C 3/08

[52] U.S. Cl. ..... 292/87; 292/DIG. 38; 292/DIG. 46

[58] Field of Search ..... 292/DIG. 38, 87, 80, 292/81, DIG. 46

[56] References Cited

U.S. PATENT DOCUMENTS

| | | | |
|---|---|---|---|
| 2,946,612 | 7/1960 | Ahlgren | 292/DIG. 38 |
| 3,083,046 | 3/1963 | Eberly | 292/87 |
| 3,841,674 | 10/1974 | Bisbing et al. . | |
| 3,850,464 | 11/1974 | Bisbing et al. . | |
| 3,918,754 | 11/1975 | Isbister | 292/DIG. 38 |
| 4,023,839 | 5/1977 | Bisbing . | |
| 4,223,787 | 9/1980 | Lowry et al. | 292/DIG. 38 |
| 4,344,646 | 8/1982 | Michel | 292/DIG. 38 |
| 4,470,624 | 9/1984 | Bisbing | 292/DIG. 38 |
| 4,655,489 | 4/1987 | Bisbing | 292/DIG. 38 |
| 4,676,081 | 6/1987 | Craig | 292/DIG. 38 |
| 4,790,579 | 12/1988 | Maxwell et al. . | |
| 4,909,551 | 3/1990 | Buchanan | 292/DIG. 38 |
| 4,964,661 | 10/1990 | Cadwell et al. | 292/DIG. 38 |
| 4,971,372 | 11/1990 | Gunderson | 292/DIG. 38 |

FOREIGN PATENT DOCUMENTS

| | | | |
|---|---|---|---|
| 2443 | 6/1979 | European Pat. Off. | 292/DIG. 38 |
| 2186315 | 8/1987 | United Kingdom | 292/87 |
| 2228971 | 9/1990 | United Kingdom | 292/DIG. 38 |
| 8607406 | 12/1986 | World Int. Prop. O. | 292/DIG. 38 |

OTHER PUBLICATIONS

Southco Fasteners Handbook 37 (Southco, Inc., PA 1987) p. GG-10.

Fastener Facts (Camloc Products, NJ, Jan. 1991).

Drawings (Rexnard Inc., NJ, Feb. 1, 1990).

*Primary Examiner*—Eric K. Nicholson

*Attorney, Agent, or Firm*—Paul and Paul

[57] ABSTRACT

A slam latch for a sliding or hinged cabinet door has a body formed from side and rear walls from which extends a flexible lower plate having a catch. The latch mounts in an aperture positioned so that the flexible lower plate extends beyond the edge of the door and over the edge of an adjacent panel to secure the two together.

4 Claims, 2 Drawing Sheets

SLAM LATCH

BACKGROUND OF THE INVENTION

1. Field Of The Invention

This invention relates generally to latching devices and more particularly to slam latch for latching sliding or hinging doors, panels or the like.

2. Brief Description of the Prior Art

Various types of latching devices for latching sliding or hinging doors or panels are known. Some types incorporate a spring member which urges a catch into a latched position about a keeper. A handle is also provided in some types so that the catch can be moved away from the keeper against the force of the spring, and into an unlatched position, when the door is opened or closed. When the door is being closed the handle can be grasped so that the catch does not engage the keeper until after the door has been fully closed. Some latches permit the door to be slammed closed, and the moving catch is forced over the keeper against the force of the spring. However, the handle of such a latch which extends beyond the body may prevent use of the device in certain confined areas. In addition, the external spring may become overstressed from the movement of the catch against the force of the spring into the unlatched position. There is a need for a simple, reliable slam latch which can be easily disengaged and which includes a minimum number of parts.

SUMMARY OF THE INVENTION

The present invention provides a slam latch for mounting in a first panel, such as a sliding or hinged door for a cabinet, or the like, for releaseably retaining an abutting second panel against the first panel. The second panel can be a part of the body or chassis of the cabinet. The slam latch can be mounted in either the stationary panel or the moving panel. The slam latch of the present invention can be molded as a single unit, a great advantage in manufacturing the latch, and is easily disengagable.

The first panel, in which the slam latch is mounted, has an inner and an outer surface, and a latch-receiving aperture formed therein proximate an edge of the panel for mounting the slam latch. The second panel has edge which abuts the edge of the first panel when the first panel is closed as well as its corrseponding inner and outer surfaces.

The slam latch of the present invention includes a body from which extends a flexible lower plate. The body mounts in the aperture in the first panel. The aperture in the first panel is positioned so that the flexible lower plate extends beyond the edge of the first panel and over the edge of the second panel to secure the two panels together.

The body of the slam latch includes an upper plate having an opening formed therein and an inner surface. The inner surface of the upper plate abutts the outer surface of the first panel proximate the aperture when the slam latch is mounted in the first panel. The body further includes a rear wall extending inwardly from the inner surface of the upper plate, and a pair of generally parallel side walls extending inwardly from the upper plate. The side walls are joined to the rear wall. When the slam latch is mounted in the aperture in the first panel, the side and rear walls extend through the aperture and inwardly beyond the inner surface of the first panel.

The flexible lower plate of the slam latch extends from the rear wall of the body, generally parallel to the upper plate, and beyond the edge of the first panel when the slam latch is mounted therein. The lower plate has a catch formed at an end thereof. The catch has a camming surface and a locking surface formed thereon. The camming surface is adapted to contact and pass over the edge of the second panel as the first panel and second panels are being latched together. The edge of the second panel forces the flexible lower plate backwards or inwardly as the panels are being latched together. The rear wall springs forward as the catch completes passing over the edge of the second panel, allowing the locking surface to be positioned proximate the inner surface of the edge of the second panel.

Advantageously, the present invention provides a sliding slam latch which is easy to manufacture, and at low cost, and which can be provided in a one-piece assembly.

DETAILED DESCRIPTION

Figure 1:
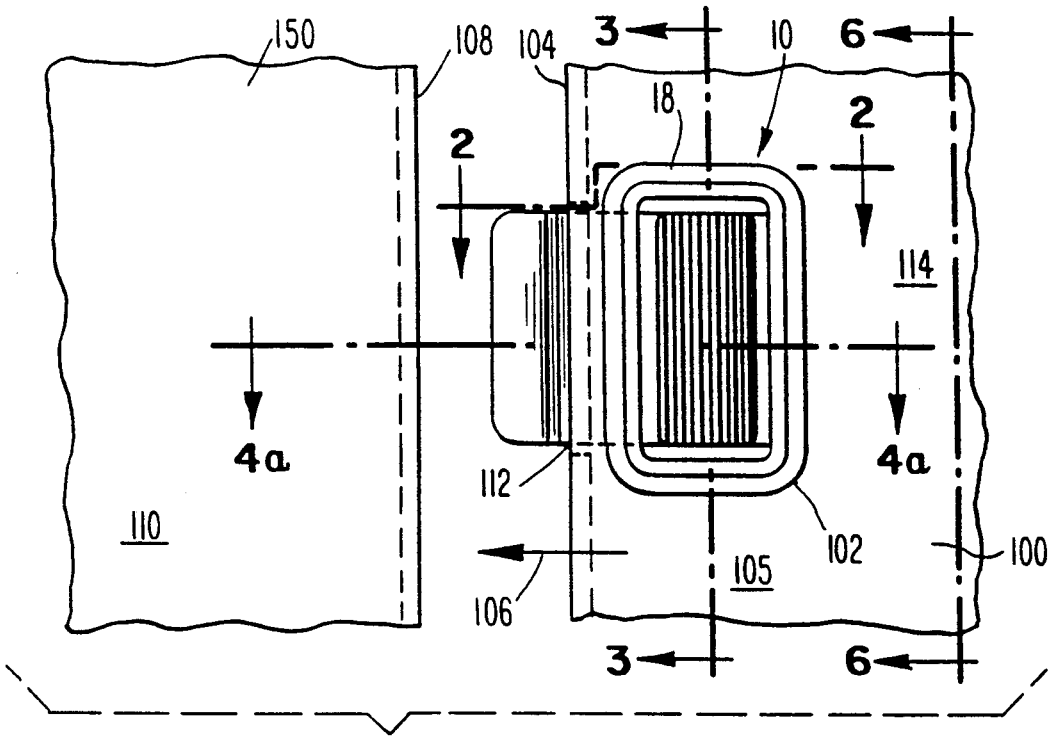
FIG. 1 is a side elevational view of a slam latch of the present invention mounted in a first panel and in an unlatched position, shown proximate a second panel which is to be latched to the first panel.

Referring now to the drawings in detail, wherein like reference numerals indicate like elements throughout the several views, there is shown in the side elevational view of FIG. 1 a slam latch 10 according to the present invention mounted in a first panel or door 100 of a cabinet 150. A latch-receiving aperture 102 is formed in the first panel 100 proximate an edge 104 thereof to receive the slam latch 10.

The slam latch 10 is molded as a single unit from a suitable grade of synthetic plastic material.

The first panel 100 is mounted in tracks not shown) to be slideable in the direction of the arrow 106 to close the first panel 100 by sliding the first panel 100 up against an edge 108 of a second panel 110 of the cabinet 150. The second panel 110 can be a portion of the chassis or carcase of the cabinet 150, another slidable panel, or the like.

Alternatively, the first panel 100 could be mounted by hinges (not shown) to be pivotable in the direction of the arrow 106 to close the first panel 100 by pivoting the first panel 100 up against the edge 108 of the second panel 110 of the cabinet 150.

Figure 2:
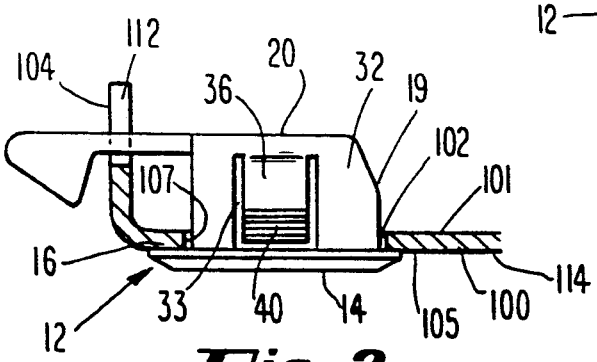
FIG. 2 is a top plan view of the slam latch of FIG. 1 taken along the lines 2—2.

A top plan view of the slam latch 10 of FIG. 1 taken along the lines 2—2 is shown in FIG. 2. The edge 104 of the first panel 100 extends at a right angle from the front portion 105 of the first panel 100. A cut-out 112 is formed in the edge 104 proximate the latch-receiving aperture 102. The second panel 110 includes a corresponding edge 108, against which the edge 104 of the first panel 100 abuts when the first panel 100 is closed.

The slam latch 10 includes a body 12 having an upper plate 14 with an inner surface 16. As best seen in the side elevational view of FIG. 1 and the sectional view of FIG. 3, the upper plate 14 is formed having an opening 18 therein which extends through the body 12. The first panel 100 has an outer surface 114 against which the inner surface 16 of the upper plate 14 abuts when the slam latch 10 is mounted in the first panel 100.

Figure 4A:
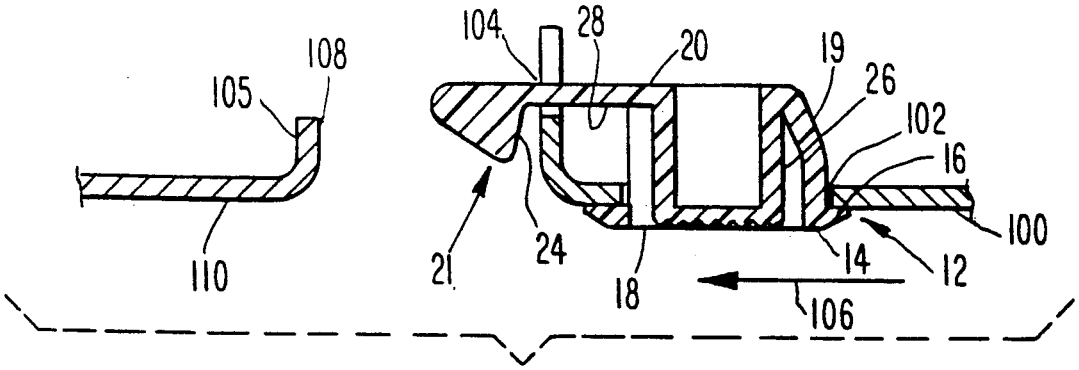
FIG. 4*a* is a sectional plan view of the slam latch of FIG. 1 taken along the line 4*a*—4*a*.
Figure 4B:
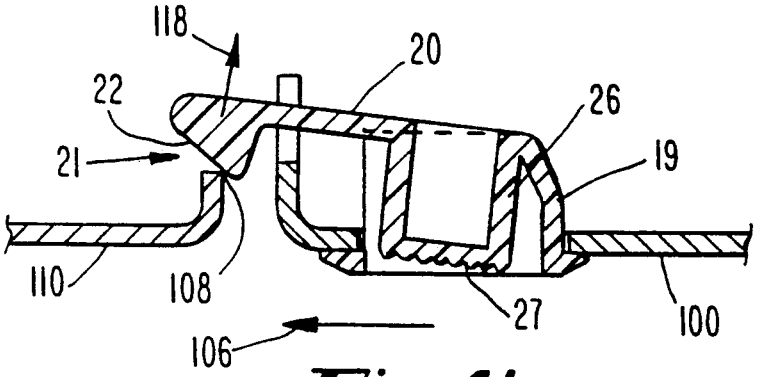
FIG. 4*b* is a sectional plan view showing the flexible lower plate of the slam latch of FIG. 4*a* forced backwards as the panels are being latched together.
Figure 4C:
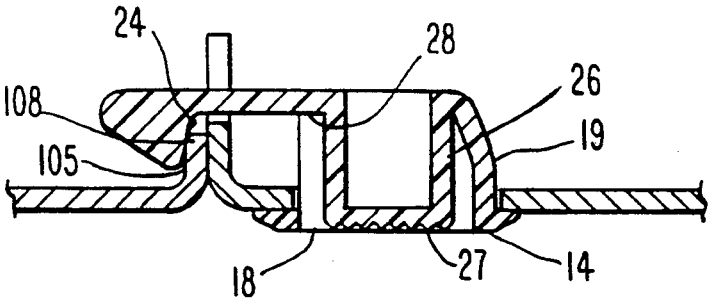
FIG. 4*c* is a sectional plan view showing the slam latch of FIG. 4*a* in a latched position.

As best seen in the sectional plan views of FIGS. 4a—4c, the body 12 further includes a rear wall 19 which extends inwardly from the inner surface 16 of the upper plate 14.

Figure 3:
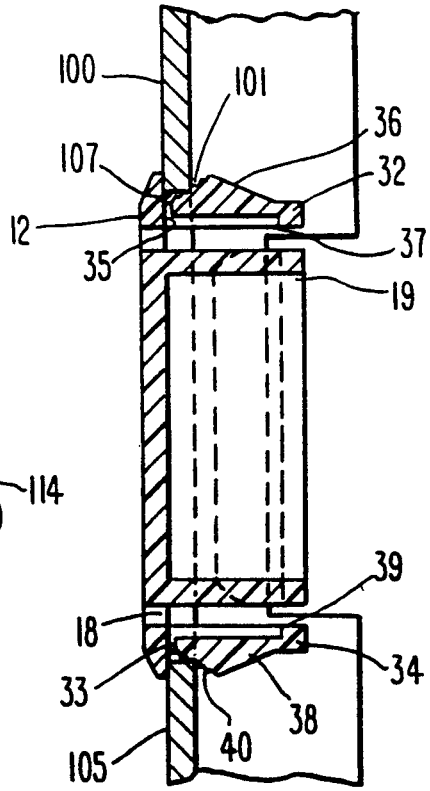
FIG. 3 is a sectional elevational view of the slam latch of FIG. 1 taken along the line 3—3.
Figure 6:
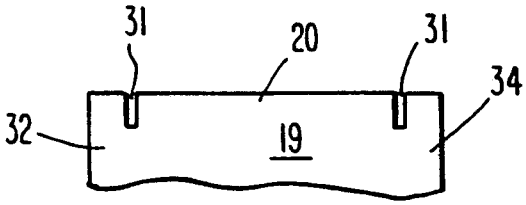
FIG. 6 is a fragmentary elevational view of the slam latch of FIG. 1 taken along the line 6—6.

A sectional elevational view of the slam latch of FIG. 1 taken along the line 3—3 is shown in FIG. 3. As best seen in FIGS. 2 and 3, a pair of generally parallel side walls 32 and 34 (34 not visible in FIG. 2) also extend inwardly from the upper plate 14 and are each joined to the rear wall 19. Each side wall 32, 34 is formed with a cut-out 33, 35 respectfully, therein. Each side wall 32, 34 also includes a tongue 36, 38 which extends outwardly from one end 37, 39 of a respective cutout 33, 35 toward the upper plate 14. As best seen in FIG. 3, the tongues 36 and 38 are adapted to contact and press against the inner surface 101 of the first panel 100 proximate the aperture 102 or the panel surface 107 surrounding the aperture 102 when the slam latch 10 is mounted in first panel 100. A plurality of steps or ridges 40 are formed on the outer surface of each of the tongues 34, 36 proximate the upper ends thereof for engaging and locking the tongues 34, 36 against the first panel 100. When the slam latch 10 is mounted in the aperture 102, the tongues 34, 35 contact the inner surface 101 of the first panel 100 and/or the panel surface 107 surrounding the aperture 102, and are pushed inwardly to lock the slam latch 10 in the aperture 102.

In the alternative, the slam latch 10 could be provided with a plurality of openings (not shown) within upper plate 14, to accommodate screws or other fastening means (not shown) to secure the slam latch 10 against outer surface 105.

A sectional plan view of the slam latch 10 of FIG. 1 taken along the line 4a—4a is shown in FIG. 4a. The flexible lower plate 20 extends generally parallel to the upper plate 14 from the rear wall 19 of the body 12, and beyond the edge 104 of the first panel 100 when the slam latch 10 is mounted in the latch-receiving aperture 102. A catch 21 is formed on the lower plate 20 at the end opposite the wall 19. The catch 21 is formed with a camming surface 22 which will contact and pass over the edge 108 of the second panel 110, and force the flexible lower plate 20 backwards, as the first panel 100 and second panel 110 are being latched together, as illustrated in FIG. 4b. The catch 21 is also formed with a locking surface 24 to latch the second panel 110 against the first panel 100. As illustrated in FIG. 4c, the rear wall 19 will spring forward as the catch 21 passes over the edge 108 of the second panel 110, allowing the locking surface 24 to be positioned proximate the inner surface 105 of edge 108 of the second panel 110.

Figure 5:
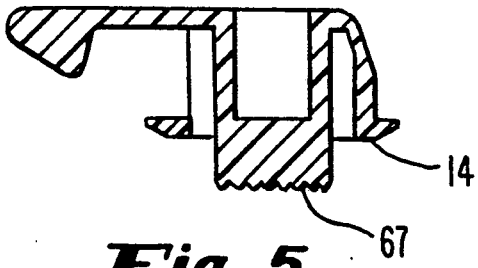
FIG. 5 is a sectional plan view of a second embodiment of a slam latch according to the present invention.

As shown in the fragmentary elevational view of FIG. 5, a pair of notches 31 can be provided between the side walls 34, 36 and the rear wall 19 to provide some additional freedom of movement to the lower plate 20 which extends from the rear wall 19 proximate the inner end thereof.

A release means 26 is provided to open the slam latch 10 and permit the first panel 100 to be unlatched from second panel 110. The release means 26 extends forward from a front surface 28 of the lower plate 20, and within the side walls 32, 34 and rear wall 19 of the body 12. An operator can apply a force to the lower plate 20 by contacting the release means 26 through the opening 18 in the upper plate 14, and force the flexible lower plate 20 backwards in the direction of the arrow 118 to allow first panel 100 to be slid in the direction opposite of the arrow 106 to open the first panel 110. The upper surface 27 of the release means has a plurality of ridges 29 formed therein to provide the operator a non-slip surface so that the operator can apply a force which will both release the slam latch 10 and move the first panel 100 away from the second panel 110.

While the release means is illustrated in FIG. 4c having an upper surface 27 positioned flush with upper plate 14, the release means may extend further, having an upper surface 67 positioned above upper plate 14, as in the second emdodiment of the present invention shown in FIG. 5, or may extend lower, having an upper surface positioned below the upper plate 14 (not shown).

The slam latch 10 of the present invention can be manufactured by conventional techniques, such as injection molding from thermoplastic or thermosetting materials. It should be understood, however, that the slam latch 10 can be made of any suitable material, without departing from the spirit of the invention. It will be recognized by those skilled in the art that the changes may be made to the above-described embodiments of the invention without departing from the broad inventive concepts thereof. For example, instead of securing together two panels, the latch can be used to secure a door to some other stationary element, such as a frame member. It is understood, therefore, that this invention is not limited to the particular embodiments disclosed, but is intended to cover all modifications which are within the scope and spirit of the invention as defined by the appended claims.

I claim:

1. A slam latch for mounting in a first panel having an inner and an outer surface and a latch-receiving aperture formed therein proximate an edge thereof, the slam latch releaseably retaining an abutting second panel against the first panel when the first panel and second panel are latched together, the second panel having an edge and inner surface, the slam latch comprising:

a) a body including;

1) an upper plate having an opening formed therein extending through the body and an inner surface, the inner surface of the upper plate abutting the outer surface of the first panel proximate the aperture when the slam latch is mounted therein:

2) a rear wall extending inward from the inner surface of the upper plate; and 3) a pair of generally parallel side walls extending inward from the upper plate; the side walls being joined to the rear wall; and b) a flexible lower plate extending from the rear wall of the body and generally parallel the upper plate, the lower plate having a catch formed at an end thereof, the lower plate extending beyond the edge of the first panel when the slam latch is mounted therein, the catch having a camming surface and a locking surface formed thereon, the camming surface being adapted to contact and pass over the edge of the second panel as the first panel and second panels are being latched together, the edge of the second panel moving the catch backwards away from the second panel in a direction generally perpendicular the axis thereof thereby forcing the flexible lower plate backwards away from the upper plate as the panels are being latched together, the rear plate springing forward as the catch completes passing over the edge of the second panel, the locking surface then being positioned proximate the inner surface of the edge of the second panel.

2. A slam latch according to claim 1 wherein the lower plate further comprises release means extending from a front surface of the lower plate and within side walls and rear wall of the body, the slam latch being releasable by an operator by contacting and pressing downward the release means through the opening in the upper plate for forcing the flexible lower plate backwards away from the upper plate.

3. A slam latch according to claim 1 wherein each side wall has a cutout formed therein a tongue extending from one edge of the cutout outwardly and toward the upper plate, the tongues being adapted to contact and press against the first panel proximate the aperture when the slam latch is mounted therein.

4. A slam latch for mounting in a first panel having an inner and an outer surface and a latch-receiving aperture formed therein proximate an edge thereof, the slam latch releaseably retaining an abutting second panel against the first panel when the first panel and second panel are latched together, the second panel having an edge and inner surface, the slam latch comprising:

a) a body including:

1) an upper plate having an opening formed therein extending through the body and an inner surface, the inner surface of the upper plate abutting the outer surface of the first panel proximate the aperture when the slam latch is mounted therein;

2) a rear wall extending inward from the inner surface of the upper plate; and 3) a pair of generally parallel side walls extending inward from the upper plate, the side walls being joined to the rear wall, each side wall having a cutout formed therein a tongue extending from one edge of the cutout outwardly and toward the upper plate, the tongues being adapted to contact and press against the first panel proximate the aperture when the slam latch is mounted therein; and b) a flexible lower plate extending from the rear wall of the body and generally parallel the upper plate, the lower plate having a catch formed at an end thereof, the lower plate extending beyond the edge of the first panel when the slam latch is mounted therein, the catch having a camming surface and a locking surface formed thereon, the camming surface being adapted to contact and pass over the edge of the second panel as the first panel and second panels are being latched together, the edge of the second panel moving the catch backwards away from the second panel in a direction generally perpendicular the axis thereof thereby forcing the flexible lower plate backwards away from the upper plate as the panels are being latched together, the rear plate springing forward as the catch completes passing over the edge of the second panel, the locking surface then being positioned proximate the inner surface of the edge of the second panel, the lower plate further comprising release means extending forward from the front surface of the lower plate and within side wall and rear walls of the body, the slam latch being releasable by an operator by contacting and pressing downward the release means through the opening in the upper plate for forcing the flexible lower plate backwards away from the upper plate.

* * * * *